US006582038B2

(12) United States Patent
Moreno-Olguin et al.

(10) Patent No.: US 6,582,038 B2
(45) Date of Patent: Jun. 24, 2003

(54) STORAGE BIN MOUNTING SYSTEM FOR A REFRIGERATOR DOOR

(75) Inventors: Arturo Moreno-Olguin, Nuevo León (MX); José Angel Avalos-Barcenas, San Luis Potosí (MX); Guilherme Nehring, Brasil (BR); Antonio Cortez-Garcia, Nuevo León (MX)

(73) Assignee: Comercial Acros Whirlpool, S.A. de C.V., Neuvo Leon (MX)

( * ) Notice: Subject to any disclaimer, the term of this patent is extended or adjusted under 35 U.S.C. 154(b) by 0 days.

(21) Appl. No.: 09/904,258

(22) Filed: Jul. 12, 2001

(65) Prior Publication Data

US 2003/0011291 A1 Jan. 16, 2003

(51) Int. Cl.[7] ..... F25D 11/00
(52) U.S. Cl. ..... 312/405.1; 312/321.5
(58) Field of Search ..... 312/405.1, 321.5, 312/408; 108/110, 107; 211/90.01, 90.02, 90.04, 94.01, 119.003; 403/326, 329, 321, 322.5, 325

(56) References Cited

U.S. PATENT DOCUMENTS 2,528,807 A * 11/1950 Whitney ..... 108/110
2,746,828 A * 5/1956 Amore ..... 211/90.01
2,784,044 A * 3/1957 Kurowski ..... 211/135
4,294,498 A * 10/1981 Van Luit ..... 16/389
4,859,010 A 8/1989 Jeziorowski
4,908,544 A 3/1990 Lau
4,921,315 A 5/1990 Metcalfe et al.
5,004,305 A * 4/1991 Montuoro et al. ..... 312/350
5,322,366 A * 6/1994 Revlett et al. ..... 248/221.11
5,375,924 A 12/1994 Pohl et al.

* cited by examiner

*Primary Examiner*—Janet M. Wilkens
(74) *Attorney, Agent, or Firm*—Abelman, Frayne & Schwab

(57) ABSTRACT

A storage bin mounting system is used in a refrigerator door having an inner liner formed by supporting side walls, which extend forwardly of a back wall defining a cavity. At least a vertically extending rib is formed integrally in each side wall and a plurality of retention elements are selectively aligned in different locations in the back wall. A storage bin includes an extending vertically slot between opposite side walls. The storage bin is mounted within the cavity of the refrigerator door, assembling the slot of the inner liner with each vertically extending rib. The height of the storage bin is adjusted within the cavity with an upwardly or downwardly slidable movement.

12 Claims, 6 Drawing Sheets

STORAGE BIN MOUNTING SYSTEM FOR A REFRIGERATOR DOOR

FIELD OF THE INVENTION

The present invention is related to storage bins for refrigerators and more specifically to a storage bin which is adjustable with an upwardly or downwardly movement within a cavity defined in a refrigerator door.

BACKGROUND OF THE INVENTION

In the refrigerator doors of the previous art, an inner door liner is formed from a suitable plastic sheet, which includes integral shelves for storing refrigerated food items. Each shelf has an associated retainer to provide lateral support for items being stored on the shelves, and, in particular, for preventing stored items from tipping or sliding off the shelves when the refrigerator door is swung open or closed. The shelves and retainer may be of any desired length depending on the configuration and size of the refrigerator door.

Also, it is well know that a great variety of items are accommodated on the shelves of the refrigerator door, which are of different sizes and forms.

However one of the disadvantages of the previous art, is that in some cases is not possible to accommodate an item (depending of height or volume) on the shelves, and the user requires to place the item in other position i.e. in a horizontal position, within of the cabinet of the refrigerator.

In order to solve the problems of the previous art, removable or adjustable bins were proposed in various U.S. patents. For example, U.S. Pat. No. 4,859,010 of Les A. Jeziorowski issued on Aug. 22, 1989, provides a refrigerator door bin assembly that includes a refrigerator door with an inner liner having a cavity defined by a rear wall and two forwardly projecting supporting side walls. Each of the side walls includes an inwardly projecting shoulder having an upwardly facing ledge that slopes downwardly toward the rear wall at a predetermined angle. A bin is provided for insertion into the cavity between the side walls. The bin comprises upstanding walls each having an outwardly extending arm. The arm has a downwardly facing surface that slopes downwardly at the predetermined angle such that the downwardly facing surface of the arm is adapted to at least partially engage the ledge during insertion and lie flush on the ledge once inserted into the cavity. The bin further includes laterally extending flanges adapted to engage the ends of the supporting side walls so as to cooperate with the arms and ledges to positively locate the bin in the door cavity. The flanges help to locate the bin above the shoulders in the door liner so that the bin can move downwardly into engagement with the shoulders to positively locate the bin in the cavity.

The U.S. Pat. No. 4,908,544 of Robert G. Lau issued on Mar. 13, 1990, provides a storage bin mounting system, which includes a pin and hook arrangement that prevents large bins from being mounted on certain areas of a refrigerator door to prevent interference with refrigerator members mounted in the refrigerator compartment opposite to those areas of the door.

The U.S. Pat. No. 4,921,315 of Metcalfe, et al, issued on May 1, 1990, is related to a refrigeration apparatus having a plurality of containers removably stored on the inner liner portion of the refrigeration apparatus door. Releasable locking structure is provided for retaining the containers in association with the door, notwithstanding the normal movement thereof in the ordinary use of the refrigeration apparatus.

Finally, the U.S. Pat. No. 5,375,924 of Douglas A. Pohl issued on Dec. 27, 1994, provides a refrigerator door bin assembly in which the inner door panel has opposite sidewalls defining a space, a bin having support surfaces on opposite sides of the bin and a mounting device to removably and adjustably attach the bin to the door such that the bin is located between the opposite sidewalls of the door and such that its position may be easily adjusted, or the bin removed from the door. The mounting of the bin on the door is accomplished by a plurality of ribs extending inwardly from the opposite sidewalls of the door, each rib having first and second rib surfaces which extend at acute angles to the support surfaces on the bin, and a third rib surface which extends substantially parallel to the support surfaces.

However, for adjusting the door bins in a refrigerator door and for accommodating a range of items placed therein in different sizes, the user require to remove the items of the bin; removing the bin from the interior space of the refrigerator, locating the bin in a different position, and accommodating again the items on the bin. The bin is located on a plurality of ribs, which are extending inwardly from the opposite sidewalls of the door, each rib having first and second rib surfaces which extend at acute angles to support surfaces on the bin.

So, depending upon design, there are more or less tendency toward to remove and locate the bins in different positions within the refrigerator door. However, in all the cases, is necessary to remove and accommodate the bin in different positions in order to facilitate the organization of the items.

In accordance with the above, the present invention is related to a storage bin mounting system for a refrigerator, which includes a storage bin that is provided with two side walls, a rear wall, a front wall and a bottom wall. The rear wall of the storage bin is configured in accordance with a rear wall of a refrigerator door. The side walls having a vertical slot defined between a first slide support and a second slide support; and at least a resilient tab member, said resilient tab member being projected outwardly from the edge of the rear wall, each resilient tab member having a snap like-member, and a finger pull flange in order to the user can pull back the tab members of the storage bin. The bin is associated with an inner liner of a refrigerator door. The inner liner including side walls which extend forwardly of a rear wall to define a cavity therebetween. The side walls of the liner are provided with a vertical rib raised from each side wall proximate to the front of the inner liner. The vertical rib including a bottom rib connected horizontally with the vertical rib, which is projected toward the rear wall of the inner liner. A guide rail is located in a vertical position at the bottom of both side walls of the liner, which is located in a parallel position with respect to each vertical rib. At least a plurality of recesses are located in a vertical position at the rear wall of the inner liner, each recesses including a horizontal bottom face and an upwardly arcuate triangle face. The recesses are created to receive said movable tab member of the bin. So, when the user requires to adjust the bin, the resilient tab member is dislodged and the bin can be slidable with an upwardly or downwardly movement on the vertical rib of the inner liner. The height of the bin will be adjusted in accordance with the size of the items and will not be necessary to remove the bin from the refrigerator door.

SUMMARY OF THE INVENTION

In accordance with the above, a first objective of the present invention is to provide a storage bin mounting system for a refrigerator, which is adjusted upwardly or downwardly on a cavity defined in the inner liner of a refrigerator door.

Is other objective of the present invention, to provide a storage bin mounting system for a refrigerator, in which the bin does not require to be removed from the inner liner of the refrigerator door to be adjusted to the new size of the items.

Another objective of the present invention is to provide a storage bin mounting system for a refrigerator, wherein the bin includes flexible tabs that are easily dislodged of a plurality of recesses formed in the inner liner of a refrigerator door in order to adjust the bin at a desired height by the user.

An additional objective of the present invention is to provide a storage bin mounting system for a refrigerator, wherein the bin is mounted on a vertical rib raised in a side wall proximate to the front of the inner liner, which permits that the bin can be slidable mounted within a cavity defined in the refrigerator door.

These and other objectives and additional advantages of the present invention will be made evident to experts in the field in the following detailed description of the invention, which will make reference to a specific embodiment of the invention in an illustrative, but not limiting sense.

DESCRIPTION OF THE PREFERRED EMBODIMENT

Figure 1:
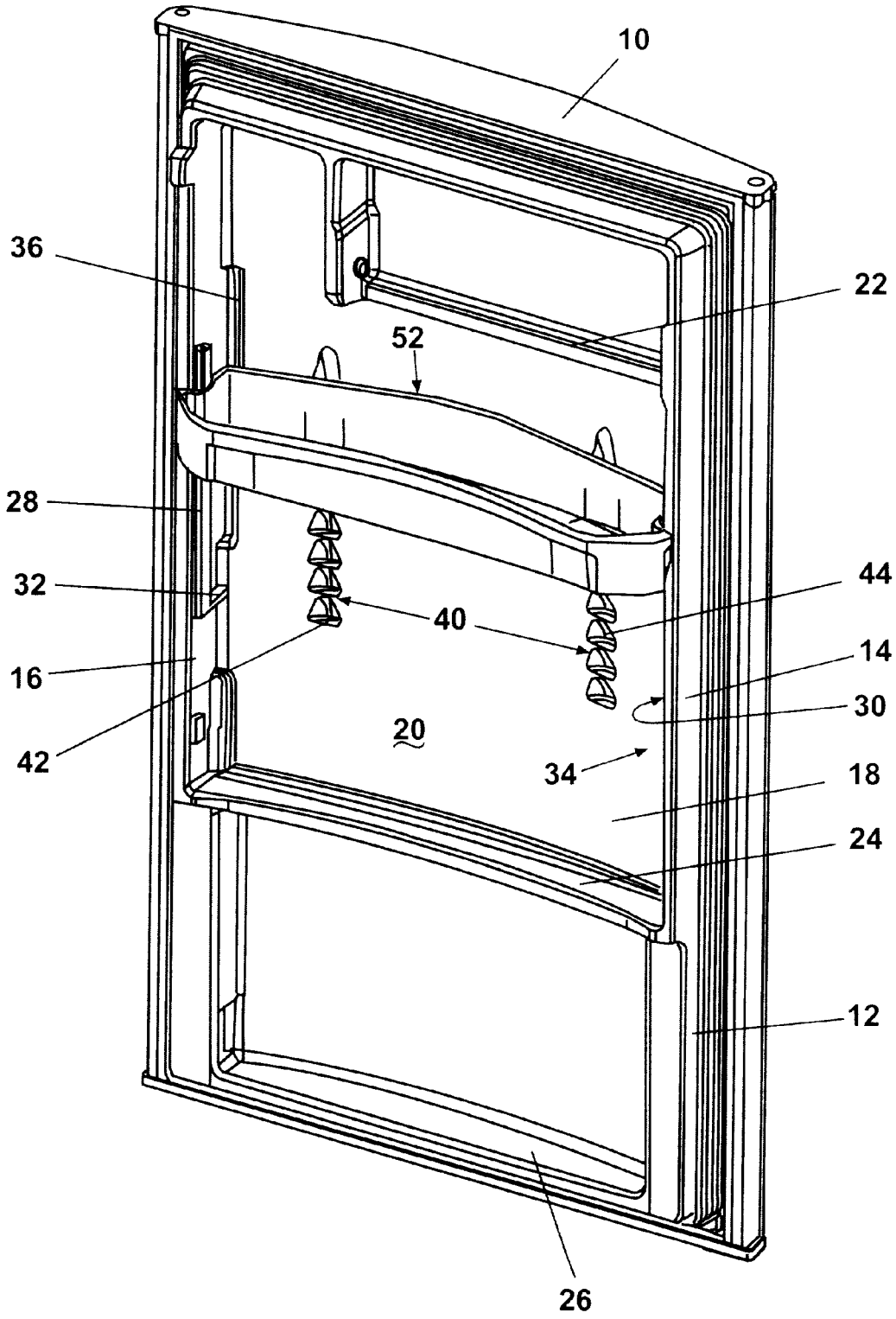
FIG. 1 is a perspective view of a refrigerator door having a storage bin system in accordance with a first embodiment of the present invention.
Figure 2:
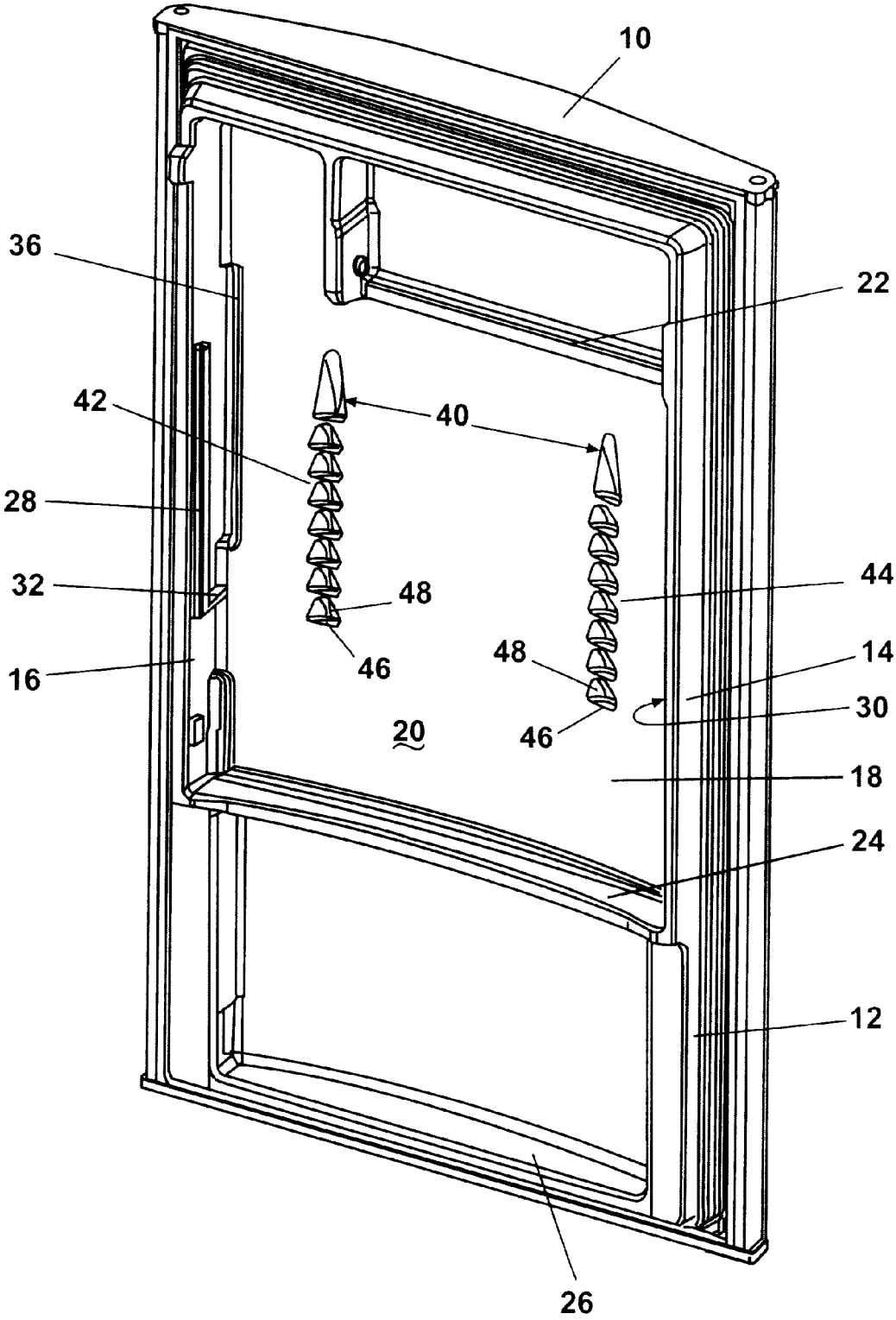
FIG. 2 is a perspective view of the refrigerator door illustrating a plurality of recesses in the inner liner of said refrigerator door, for retaining the storage bin in accordance with a first embodiment of the present invention.

In the illustrative embodiment of the invention the FIGS. 1 and 2 show a refrigerator door 10, which is provided with an inner liner 12. The inner liner 12 including supporting side walls 14, 16, which extend forwardly of a rear wall 18 to define a cavity 20 therebetween. An upper fixed shelf 22, and intermediate fixed shelf 24, and a lower fixed shelf 26 are molded with the inner liner 12, which are arranged within the cavity 20 of the refrigerator door 10, for storing refrigerated food items. Each shelf 22, 24 and 26 has an associated retainer (not shown) for providing lateral support for items being stored on the shelves.

Figure 3:
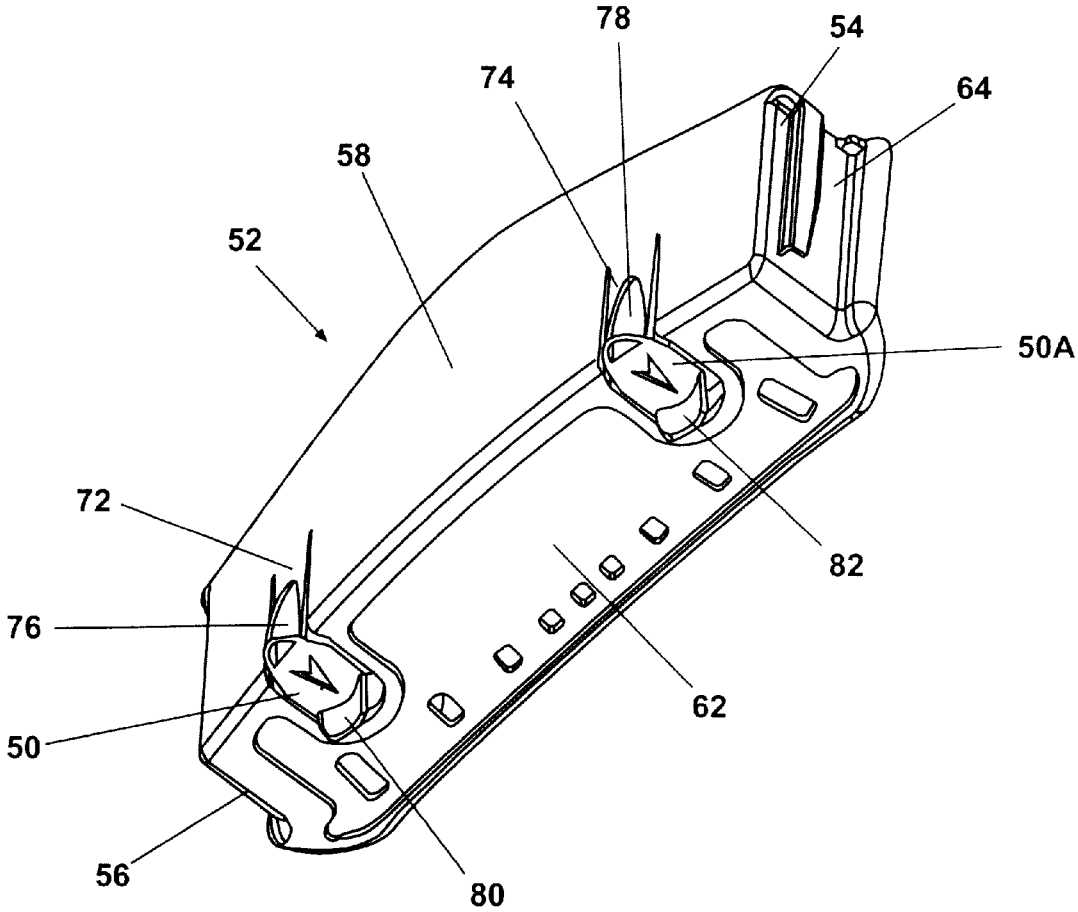
FIG. 3 is a perspective view showing the rear part of a first embodiment of a storage bin in accordance with the present invention.
Figure 4:
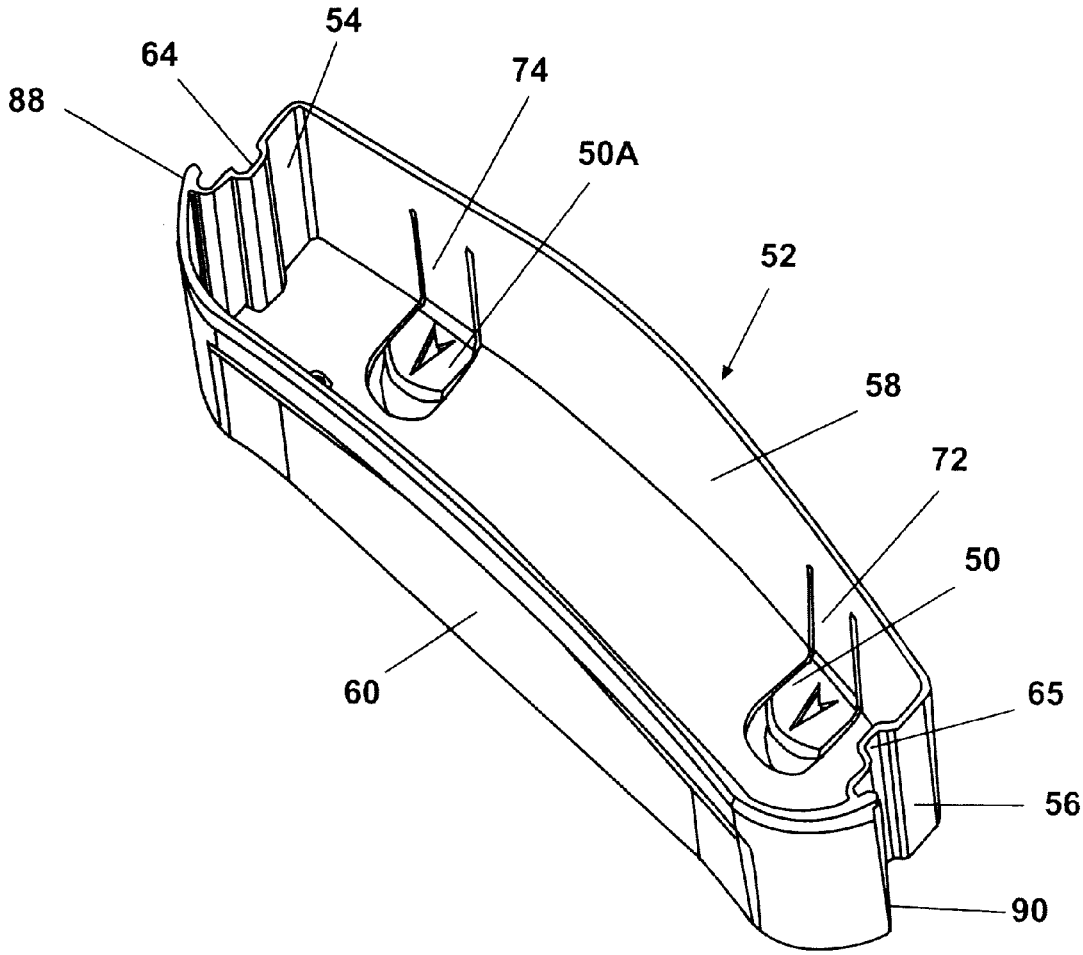
FIG. 4 is a perspective view showing the upper part of the storage bin showed in FIG. 3.

The side walls 14, 16 of the inner liner 12 are provided with a vertical rib 28, 30 raised from each side wall 14, 16, proximate to the front of the inner liner 12. Each vertical rib 28, 30, including a bottom rib 32, 34, connected horizontally with each vertical rib 28, 30, which is projected toward the rear wall 18 of the inner liner 12. A guide rail 36, 38, is located in a vertical position in the rear part of both side walls 14, 16, of the inner liner 12, which is located in a parallel position with respect to each vertical rib 28, 30. A plurality of recesses 40, which are aligned in two columns 42, 44, located in the rear wall 18 of the inner liner 12, each recess 40 including a horizontal bottom face 46 and an upwardly arcuate triangle face 48. The recesses 40 are formed to receive movable tab members 50, 50A (FIGS. 3 and 4) of a bin 52 as will described later.

A storage bin 52 for the refrigerator door 10, which includes two side walls 54, 56, a rear wall 58, a front wall 60 and a bottom wall 62. The rear wall 58 of the storage bin 52 is configured in accordance with the rear wall 18 of the refrigerator door 10. The side walls 54, 56, having configured a vertical slot 64, 66. The rear wall 58 of the storage bin 52 including the two integral tab members 50, 50A, said tab members 50, 50A, are provided with a flexible portion 72, 74. The flexible portion including a snap like member 76, 78, which is projected outwardly from the lower edge of the rear wall 58 and a finger pull flange 80, 82, in an opposite relation to the snap like-member 76, 78, in order to the user can pull back the tab members 50, 50A, from the recesses 40.

In accordance with the invention, the storage bin 52 is placed between each vertical rib 28, 30, and guide rail 36, 38, of the refrigerator door 10. The vertical slots 64, 66, are placed on each vertical rib 28, 30, in order to the storage bin 52 can be slidable with an upwardly or downwardly movement in the inner liner 12. The snap like-member 76, 78, of each tab members 50, 50A, are connected with the corresponding recesses 40, to fix the position of the storage bin 52 on the inner liner 12. The bottom rib 32, 34, is connected horizontally with each vertical rib 28, 30, which is used as security stop for the storage bin 52.

So, when the user requires adjust the storage bin 52, the finger pull flanges 80, 82, of the tab members 50, 50A, are pulled back by the user, in order to separate the snap like-member 76, 78, from each recesses 40. After, the user moves the storage bin 52 with an upwardly or downwardly movement to adjust the height of the storage bin 52 in accordance with the size of the items. Once the user has selected the height of the storage bin 52, the finger pull flanges 80, 82, are loosed and each snap like-member 76, 78, is again engaged with the corresponding recesses 40.

Figure 5:
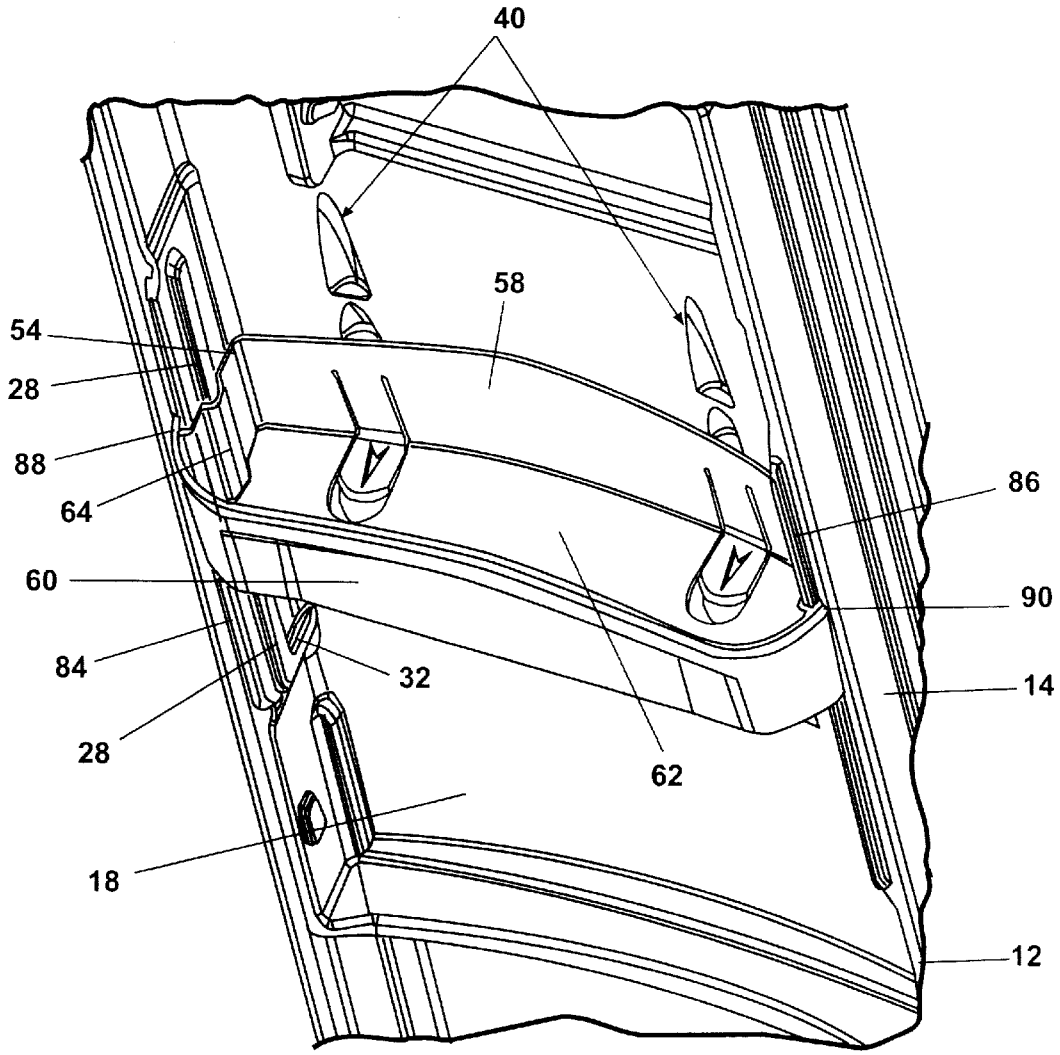
FIG. 5 is a second embodiment of the present invention, showing a sectional view of a refrigerator door and a storage bin.
Figure 6:
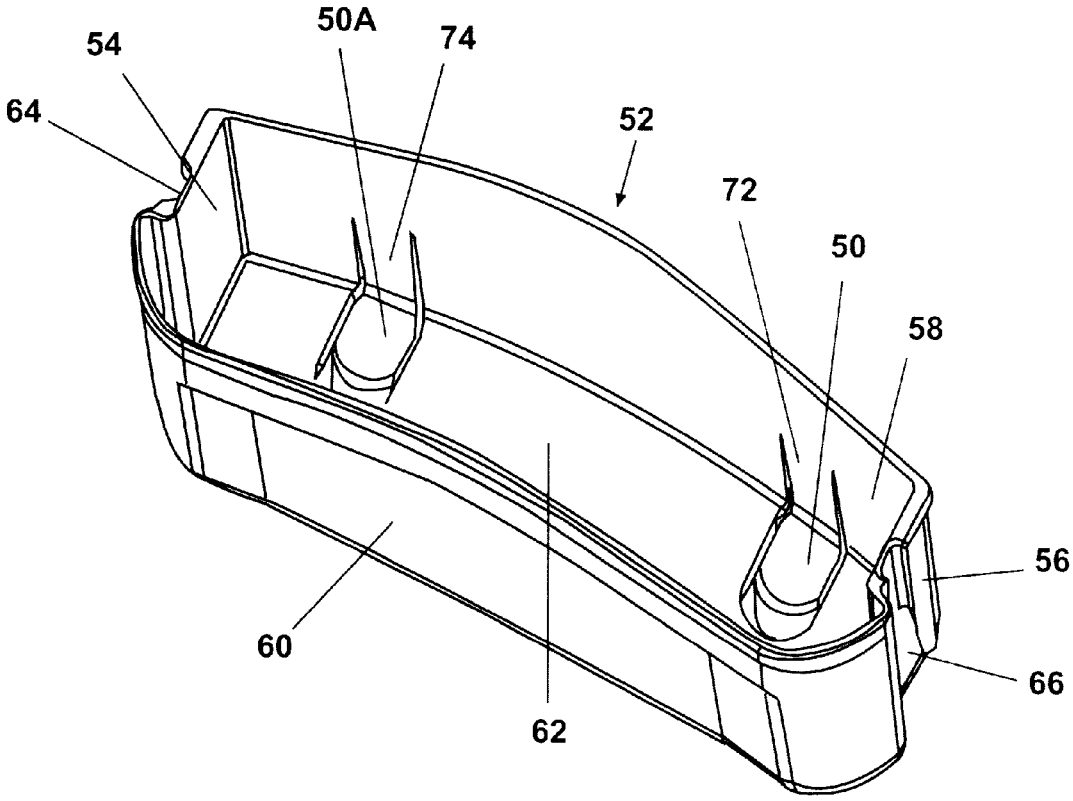
FIG. 6 is a perspective view of the storage bin showed in FIG. 5.

In the second embodiment of the present invention illustrated in FIGS. 5 and 6, the side walls 14, 16 of the inner liner 12 includes a frontal rib 84, 86, adapted to be engaged with the storage bin 52 as will described later. The vertical rib 28, 30,—which is raised from each side wall 14, 16,—is formed at approximately the intermediate part of each side wall 14, 16. As was described in the first embodiment of the present invention, each vertical rib 28, 30, includes a bottom rib 32, 34, connected horizontally with each vertical rib 28, 30, which is projected toward the rear wall 18 of the inner liner 12.

In this second embodiment of the present invention, the storage bin 52, furthermore of the vertical slots 64, 66,—that were configured in both side walls 54, 56—also includes a frontal flange 88, 90, which is configured to the shape of the frontal rib 84, 86, of the inner liner 12, in order to maintain the orientation of the storage bin 52 on the refrigerator door 10. In this way, the storage bin 52 is slidable on the frontal rib 84, 86, as well as, on the vertical ribs 28, 30.

As can be seen from the embodiments above described, a storage bin mounting system for a refrigerator is showed, which the storage bin may be easily adjusted to different heights with an upwardly or downwardly movement within the inner liner, without the need of remove the storage bin of the refrigerator door.

However, it must be understood that the invention should not be limited to the embodiment above described, and it will be apparent to the experts in the field that other diverse embodiments could be implemented, along with alternative embodiments which will be clearly contained within the spirit of the present invention which are claimed in the following claims.

We claim:

1. A storage bin mounting system for a refrigerator, comprising:

a refrigerator door having an inner liner formed by supporting side walls, which extend forwardly of a back wall defining a cavity;

at least a vertically extending rib associated with each side wall;

at least a first plurality of retention means selectively aligned in different locations in the inner liner;

at least a storage bin, each of said at least a storage bin having side walls, a rear wall, a front wall and a bottom wall, which is mounted within the cavity of the refrigerator door, each of said side walls having at least a vertically extending slot, with each respective vertically extending slot of the storage bin being positioned on a respective vertically extending rib of each respective side wall forming the inner liner to adjust the height of the storage bin in said cavity with an upwardly or downwardly slidable movement; and resilient coupling means connected in the rear wall of said storage bin, which in a first position, said resilient coupling means and said first plurality of retention means are engaged for securing the position of the storage bin into the cavity, and in a second position, said resilient coupling means and said first plurality of retention means are disengaged to allow the adjusting of the height of the storage bin.

2. The storage bin mounting system for a refrigerator as claimed in claim 1, wherein the first plurality of retention means are formed in the back wall associated with the inner liner.

3. The storage bin mounting system for a refrigerator as claimed in claim 1, wherein the vertically extending rib by each side wall is formed proximate to the front of the inner liner.

4. The storage bin mounting system for a refrigerator as claimed in claim 1, wherein the vertically extending rib by each side wall is formed proximate to an intermediate part of the inner liner.

5. The storage bin mounting system for a refrigerator as claimed in claim 1, wherein the vertically extending rib by each side wall includes a bottom rib connected horizontally with each vertical extending rib, which is projected toward the back wall associated with the inner liner.

6. The storage bin mounting system for a refrigerator as claimed in claim 1, wherein the at least a first plurality of retention means are recesses which are vertically aligned.

7. The storage bin mounting system for a refrigerator as claimed in claim 1, wherein the first plurality of retention means are aligned in at least two columns, said first plurality of retention means including a horizontal bottom face and an upwardly arcuate triangular face.

8. The storage bin mounting system for a refrigerator as claimed in claim 1, wherein the resilient coupling means are projected outwardly from a lower edge of the rear wall.

9. The storage bin mounting system for a refrigerator as claimed in claim 1, wherein the resilient coupling means includes at least an integral tab member, said tab member including a resilient portion, an outwardly projecting member connected with said resilient portion which is projected outwardly from a lower edge of the rear wall and a finger pull flange in an opposite relation to the outwardly projecting member for disengaging the resilient coupling means from the at least a first plurality of retention means.

10. The storage bin mounting system for a refrigerator as claimed in claim 1, wherein the storage bin mounting system further includes: at least a guide rail located in a vertical position in the rear part of said side walls, said guide rail being placed in a parallel position with respect to each vertically extending rib.

11. The storage bin mounting system for a refrigerator as claimed in claim 1, wherein the storage bin mounting system further includes: at least a frontal rib located in a vertical position in the frontal part of said inner liner, said frontal rib being placed in a parallel position with respect to each vertically extending rib.

12. A storage bin mounting system for a refrigerator comprising:

a refrigerator door having an inner liner formed by supporting side walls, which extend forwardly of a back wall defining a cavity;

at least a vertically extending rib associated with each side wall, said vertically extending rib being formed proximate to the front of the inner liner;

at least a first plurality of retention means vertically aligned in the back wall associated with the inner liner;

at least a storage bin, each of said at least a storage bin having side walls, a rear wall, a front wall and a bottom wall, which is mounted within the cavity of the refrigerator door, each of said side walls having at least a vertically extending slot, with each respective vertically extending slot of the storage bin being positioned on a respective vertically extending rib of each respective side wall forming the inner liner to adjust the height of the storage bin in said cavity with an upwardly or downwardly slidable movement; and resilient coupling means projected outwardly of the rear wall, which in a first position said resilient coupling means and said first plurality of vertically aligned retention means are engaged for securing the position of the storage bin into the cavity, and in a second position, said resilient coupling means and said at least a first plurality of vertically aligned retention means are disengaged to allow the adjusting of the height of the storage bin.

* * * * *